US008544386B2

(12) United States Patent
Keyes et al.

(10) Patent No.: US 8,544,386 B2
(45) Date of Patent: Oct. 1, 2013

(54) INTERPOSER HAVING DECURLER

(75) Inventors: Thomas C. Keyes, Fairport, NY (US); Thomas E. Bitter, Fairport, NY (US); Ronald A Ippolito, Rochester, NY (US); Dale T. Platteter, Fairport, NY (US); Richard F. Scarlata, Rochester, NY (US); Joe Marasco, Fairport, NY (US); Donald R. Fess, Penfield, NY (US); Diego A. Pereda, Fairport, NY (US); Douglas F. Sundquist, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 1464 days.

(21) Appl. No.: 11/531,024

(22) Filed: Sep. 12, 2006

(65) Prior Publication Data

US 2008/0061488 A1 Mar. 13, 2008

(51) Int. Cl.

| | |
|---|---|
| ***B41F 13/24*** | (2006.01) |
| ***B41F 13/64*** | (2006.01) |
| ***B41F 31/00*** | (2006.01) |
| ***G03G 15/00*** | (2006.01) |

(52) U.S. Cl.
USPC ..... 101/232; 101/240; 270/12; 270/14; 270/15; 399/382; 399/406

(58) Field of Classification Search
USPC ..... 101/232, 240; 270/12, 14, 15; 399/382, 399/406
See application file for complete search history.

(56) References Cited

U.S. PATENT DOCUMENTS

| | | | | |
|---|---|---|---|---|
| 4,326,915 | A | 4/1982 | Mutschler, Jr. | |
| 4,627,718 | A | 12/1986 | Wyer | |
| 5,084,731 | A | 1/1992 | Baruch | |
| 5,202,737 | A | 4/1993 | Hollar | |
| 5,221,950 | A | 6/1993 | Ford et al. | |
| 5,370,379 | A | 12/1994 | Wyer | |
| 5,398,107 | A | 3/1995 | Bartholmae et al. | |
| 5,555,083 | A | 9/1996 | Kuo et al. | |
| 5,598,257 | A * | 1/1997 | Keller et al. | 399/364 |
| 5,755,399 | A * | 5/1998 | Halvonik et al. | 242/615 |
| 6,002,913 | A | 12/1999 | Pawlik et al. | |
| 6,032,004 | A | 2/2000 | Mirabella, Jr. et al. | |
| 6,094,560 | A | 7/2000 | Thomas | |
| 6,559,961 | B1 * | 5/2003 | Isernia et al. | 358/1.14 |
| 6,603,954 | B1 | 8/2003 | Zoltner | |
| 2005/0068410 | A1 | 3/2005 | Kama | |
| 2005/0286958 | A1 | 12/2005 | Shiratori | |

* cited by examiner

*Primary Examiner* — Ren Yan
*Assistant Examiner* — Leo T Hinze
(74) *Attorney, Agent, or Firm* — Gibb & Riley, LLC

(57) ABSTRACT

Embodiments herein comprise an apparatus that includes a printing engine and an interposer adapted to receive printed sheets from the printing engine. The interposer adds insert sheets between printed sheets. The interposer includes a decurler positioned within the interposer so as to decurl the printed sheets after the interposer adds the insert sheets. The printing engine adds a curl to the printed sheets and the decurler removes the curl from the printed sheets. The decurler can comprise a roller-based decurler, a heated decurler, a pressure based decurler, and/or a moisture-vacuum based decurler.

14 Claims, 7 Drawing Sheets

INTERPOSER HAVING DECURLER

BACKGROUND AND SUMMARY

Embodiments herein generally relate to electrostatographic printers and copiers or reproduction machines, and more particularly, concerns an apparatus that includes an interposer having a decurler.

Embodiments herein comprise an apparatus that includes a printing engine and an interposer adapted to receive printed sheets from the printing engine. The interposer adds insert sheets between printed sheets. The interposer includes a decurler positioned within the interposer so as to decurl the printed sheets after the interposer adds the insert sheets. The printing engine adds a curl to the printed sheets and the decurler removes the curl from the printed sheets. The decurler can comprise a roller-based decurler, a heated decurler, a pressure based decurler, and/or a moisture-vacuum based decurler.

The decurler is positioned to be as distant from the printing engine as confines of the interposer will allow. Thus, the decurler is positioned adjacent the paper exit of the interposer. More specifically, the decurler is positioned within the interpose to allow the printed sheets to cool and is positioned to receive the printed sheets a preset time after the printing engine prints the printed sheets. These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
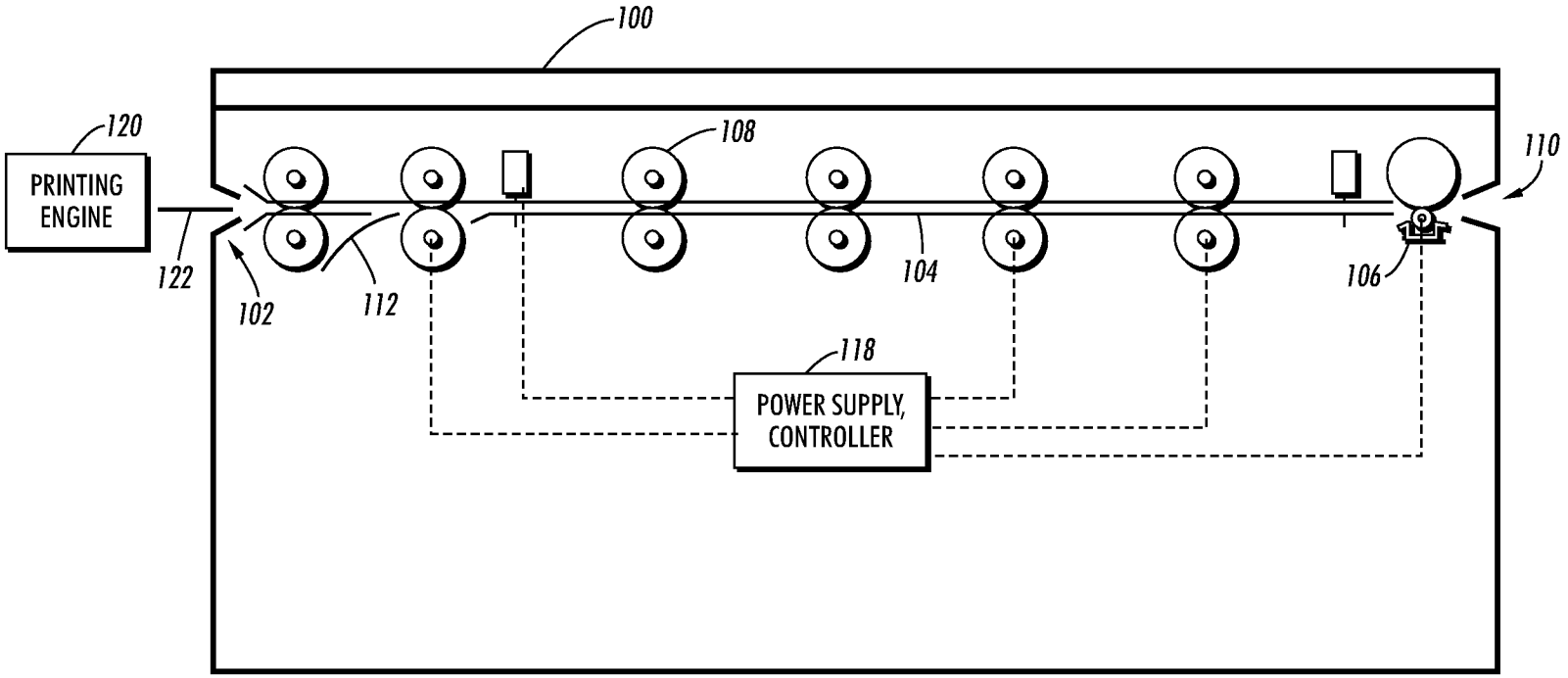
FIG. 1 is a schematic diagram of an interposer according to embodiments herein.

Heat retained in printed sheets being output by a printing engine or image output terminal (IOT) decreases the efficiency of decurlers. Therefore, as shown in FIG. 1, embodiments herein provide an apparatus that includes a printing engine 120, and an interposer module 100 that receives printed sheets 122 from the printing engine 120. An interposer 112 adds insert sheets between printed sheets as the sheets pass through the interposer module 100 along the interposer paper path 104 that includes nip rollers 108. The interposer module 100 includes a decurler 106 positioned within the interposer module 100 so as to decurl the printed sheets after the interposer 112 adds the insert sheets. The printing engine 120 adds a curl to the printed sheets 122 and the decurler 106 removes the curl from the printed sheets 122.

The decurler 106 can comprise a roller-based decurler, a heated decurler, a pressure based decurler, and/or a moisture-vacuum based decurler.

Because the decurler 106 is located within the interposer module 100, a single power supply and controller 118 can be used to operate and control both the interposer elements 112 (some of which are discussed in greater detail below) and the decurler elements 106 (some of which are also discussed in greater detail below). The power supply aspect of item 118 can be electrical and/or mechanical (operating through actuators, belts and/or pulleys) and the controller aspect of item 118 can comprise any conventional microprocessor device that can include a memory, central processing unit, and other logical devices capable of executing instructions to simultaneously control the interposer 112 and the decurler 106.

In some embodiments, the decurler 106 can be positioned to be as distant from the printing engine 120 as confines of the interposer module 100 will allow. Thus, the decurler 106 can be positioned adjacent the paper exit 110 of the interposer module 100 and as far from the paper entrance 102 as possible. Thus, in the example shown in FIG. 1, the decurler 106 is positioned within the interpose to allow the printed sheets to cool to an acceptable temperature (below 95° C.; below 90° C.; or below 85° C., for example) and is positioned to receive the printed sheets a sufficient amount of time (more than 1.5 seconds; more that 2 seconds; or more that 2.5 seconds, for example) after the printing engine 120 prints the printed sheets.

Figure 2:
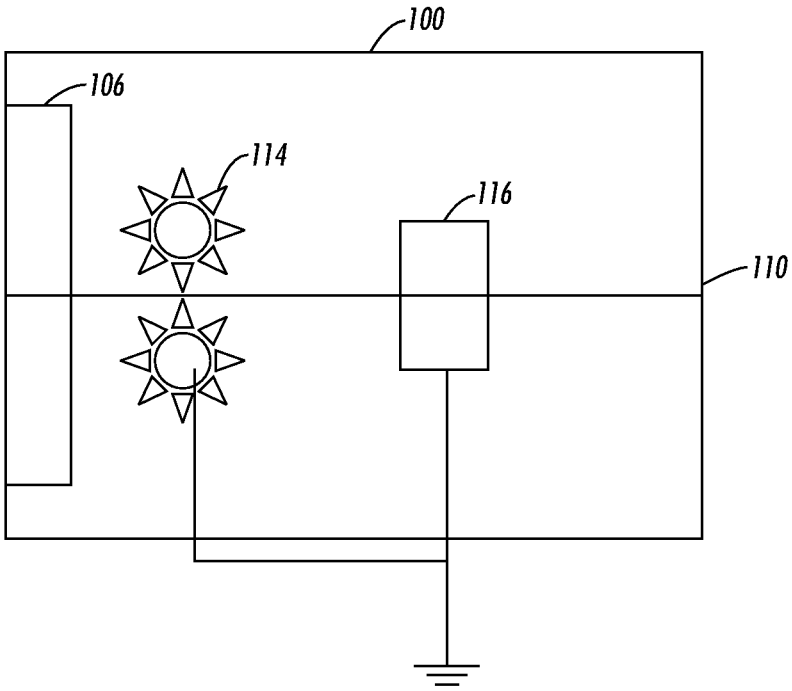
FIG. 2 is a schematic diagram of an interposer according to embodiments herein.

In one embodiment shown in FIG. 2, the interposer module 100 can include antistatic brushes 114 that are grounded (connected to ground as shown in FIG. 2) and/or baffles 116 (such as stainless steel baffles) that are grounded (connected to ground as shown in FIG. 2). The brushes 114 and/or baffles 116 are positioned between the decurler 106 (of which only a portion is shown in FIG. 2) and the interposer module exit 110 and can be aligned straight between exit of the decurler 106 and the exit of the interposer module 110 because the media is decurled at that point. The antistatic brushes 114 and baffles 116 have been found to work more effectively on decurled (straight) media that on curled media. Therefore, the charge on the media is more efficiently removed by the inventive structure, when compared to brushes that must be angled to remove charge from curled media. Such brushes 114 and baffles 116 remove static charge from the media as it moves past the brushes 114 and/or baffles 116. This allows the media to be output from the interposer module 100 without curl and without static charge.

With the structure disclosed herein, the decurler can be added to existing interposer modules (either during manufacturing or as a retrofit assembly) without incurring the expense and space of a separate deculer. Further, because the deculer can utilize the power sources (mechanical or electrical) and the controller that are already included within the conventional interposer module, the device provides substantial efficiency gains when compared to conventional structures by consuming less space and utilizing a fewer number of components.

Figure 3:
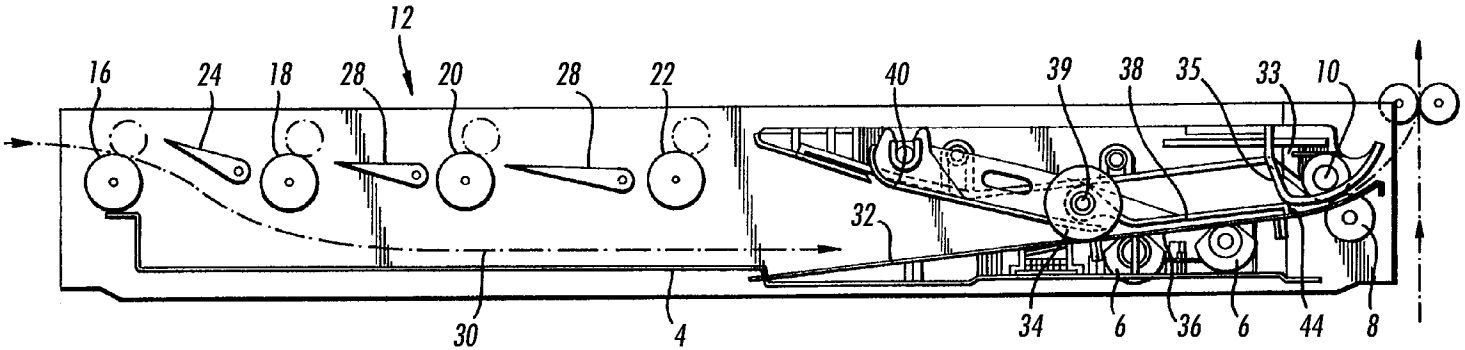
FIG. 3 is a schematic diagram of an interposer according to embodiments herein.

FIG. 3 represents one example of an interposer 112 that can be used with embodiments herein. A similar interposer is shown in U.S. Pat. No. 5,370,379 (which is fully incorporated herein by reference). In the interposer shown in FIG. 3, the incoming sheets are fed via a diverter section 12 into a duplex tray 4. The diverter section 12 comprises four pairs of feed rollers 16, 18, 20 and 22, each pair feeding incoming sheets of a particular size into the duplex tray 4. Each adjacent pair of feed rollers 16, 18, 20 and 22 has a pivotally mounted diverter arm 24, 26 and 28 therebetween. In FIG. 3 the diverter arm 24 is shown pivoted in its upward position allowing sheets to enter the duplex tray 4 along a sheet path shown by a dashed line 30. Each of the sheets is fed up the surface of a guide 32 of the tray 4 until the leading edge of the sheet locates in a nip defined between the surface of the guide 32 and a plurality of top nudger rolls 34 (only one of which is illustrated in FIG. 3). The top nudger rolls 34 are mounted at spaced locations along an axle 39 which is intermittently operated in synchronism with the arrival of the sheets so as to feed the sheets one at a time into an area of the duplex tray 4 above the bottom nudger rolls 6 where they are compiled in a stack on a support surface 36.

Immediately above the support surface 36 is a pivoted interposer device 38, the purpose of which is to intercept the incoming sheet without interrupting sheets being fed out at the same time. The interposer device 38 also provides the normal force required for the operation of the bottom nudger rolls 6 which advance the bottom sheet in the stack into the nip defined between the feed roll 8 and the retard roll 10 of a feeder 33. The feeder 33 is provided with a front registration and guide wall 35. The pivot for the interposer device 38 coincides with a shaft 39 on the ends of which are mounted the upper nudger rolls 34. The nudger rolls 34 are supported on a pivoted guide 40 and rise with the height of the stack of paper fed into the tray 4.

Figure 4:
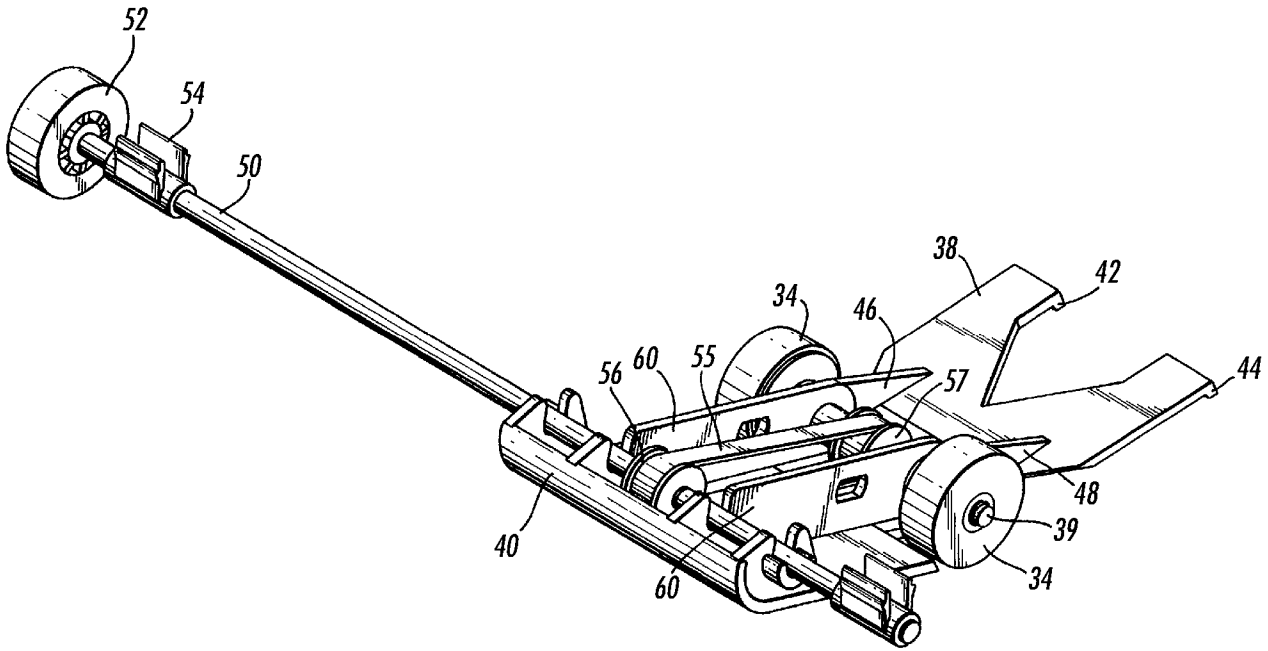
FIG. 4 is a schematic diagram of a decurler according to embodiments herein.
Figure 5:
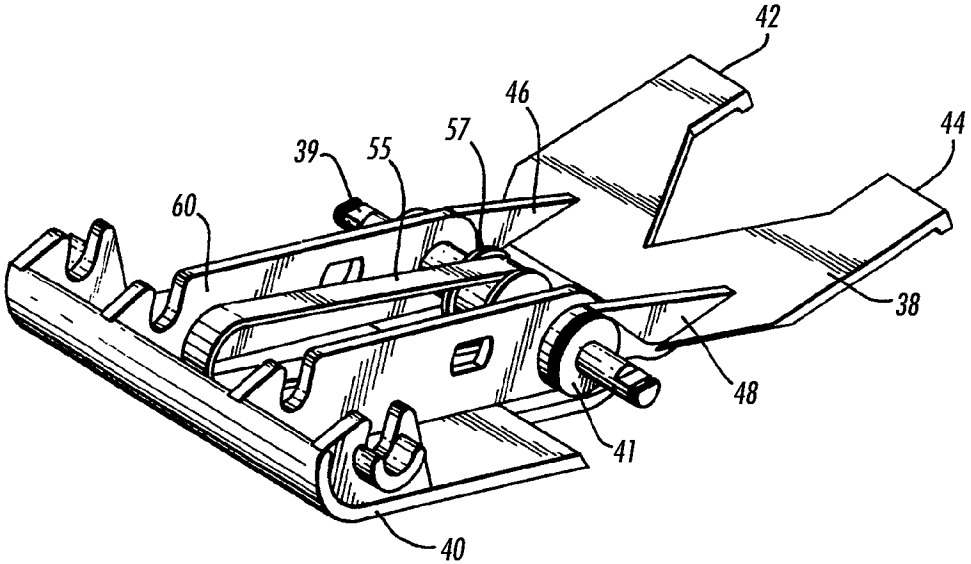
FIG. 5 is a schematic diagram of a decurler according to embodiments herein.

The interposer device 38 and its mounting arrangement are shown in more detail in FIGS. 4 and 5. The interposer device 38 is formed as a substantially flat member, conveniently made from plastics material, having one of its ends bifurcated to define two hooked interposer fingers 42, 44. The opposite end of the interposer device 38 is attached to two supports 46, 48 each of which is pivotally mounted by plastic bearings 41 (see FIG. 5) on the shaft 39 just inboard of the nudger rolls 34. The shaft 39 passes through the ends of two spaced walls 60 which form a middle portion of the guide 40, also made of plastics material, which is itself pivotally mounted on a shaft 50 one end of which is attached for rotary motion to a drive gear 52 by means of snap-fit bearings 54. Intermittent rotation of the shaft 50 is communicated to the shaft 39, and thereby to the nudger rolls 34, via a belt 55 and pulley arrangement 56, 57. Referring back to FIG. 3, and also with reference to it can be seen that the interposer fingers 42, 44 interleave with slots formed in the front guide wall 35 of the feeder 33.

In operation the first incoming sheet is fed into the tray 4 and is guided beneath the interposer device 38 which rests down onto the tray 4 under its own weight. This prevents the lead edge of the sheet from advancing into the feeder. Initially, a gap exists between the interposer device 38 and the support surface 36 of the tray 4, which gap is sufficient to accommodate only a few sheets of paper. A throat area of the feeder 33 tapers to approximately 4 mm. As described earlier, the interposer fingers 42, 44 interleave with the front wall 35 of the feeder 33 through slots which accommodate them.

As the height of the stack of paper increases, the interposer device 38 lifts with the top nudger rolls 34, which may be lifted or driven as and when necessary. The interposer fingers 42, 44 still remain "hooked" over the stack edge until the front wall 35 of the feeder 33 takes over as the registration stop for incoming sheets. When a sheet is to be fed out of the duplex tray 4, the bottom "D" shaped nudger rolls 6 rotate to contact the bottom sheet on the support surface 36 and lift the stack sufficiently to engage a "heel" of the interposer device 38. A normal force is felt and the sheet advances into the feeder 33. With a large stack the interposer device 38 remains well out of the way of the lead edge of the sheets to be fed. When the stack height reduces the interposer fingers 42, 44 will lower into the throat area but engage with the bottom nudger rolls 6 more directly and will unhook from the lead edge zone of a bottom sheet which is to be fed away. The sheets are also effectively disengaged from the interposer fingers 42, 44 by the interleaving with the feeder front wall 35.

Figure 6:
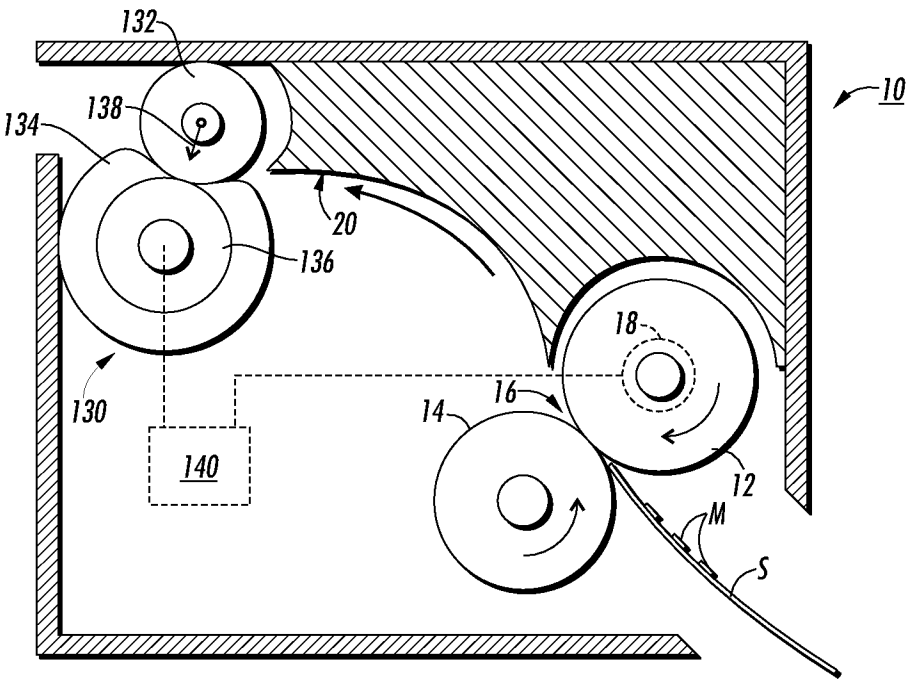
FIG. 6 is a schematic diagram of a decurler according to embodiments herein.

FIG. 6 illustrates one type of decurler useful with embodiments herein and is similar to the structure shown in U.S. Pat. No. 6,002,913, incorporated herein by reference. FIG. 6 is an elevational view showing a fuser module incorporating the decurling apparatus of the present embodiments. In an embodiment, the decurling apparatus is contained within a fuser module, here indicated as 10, in combination with a fusing apparatus of a type known in electorstatographic printing. (For purposes of the following description and claims, a "printer" can be a digital printer, digital or light-lens copier, facsimile, or multifunction device.) The fuser module 10 typically includes a first fuser roll 12 and a second fuser roll 14. The fuser rolls are mounted to roll against each other and thus form a nip 16 therebetween for the passage of a sheet therethrough. Also, as common in the art, at least one of the fuser rolls, such as 12, may include therein a heat element such as 18, which, when electrical energy is applied thereto causes the fuser roll 12 to radiate heat. Thus, as shown in the Figure, a sheet S having a quantity of image-related marking material M on one side thereof is caused to move through fuser nip 16 by the rotation of fuser rolls 12 and 14, and the heat radiated from heating element 18 causes the marking material M to become affixed to the surface of sheet S.

With specific reference to the FIG. 6, there is further provided within fuser module 10, a decurling apparatus disposed effectively downstream of the fuser rolls 12, 14 along a paper path of a sheet S passing through fuser nip 16. Sheets emerging from fuser nip 16 are caused to curve along a baffle 20, which in the present embodiment causes the sheet to curl in the direction shown, that is, away from the side of the sheet S having the marking material M (in the case of a simplex print).

The decurling apparatus comprises a rotatably-mounted "decurling roll" here indicated as 130, the specific structure of which will be described below, which operates in combination with an idler roll 132. Idler roll 132 is a roller, rotatably mounted within the module 10, which defines an axis which is disposed parallel to the axis of rotation of the decurling roll 130. A sheet emerging from fuser nip 16 and passing over baffle 20 is caused to pass through a nip between decurling roll 130 and idler roll 132, and is thus effectively decurled by passing between decurling roll 130 and idler roll 132.

There is provided in this embodiment relatively soft deformable rollers, indicated as 134 and placed as shown, and relatively hard rollers 136, also known as "velocity control rings," placed as shown. Significantly, the deformable rollers 134 define a radius from the axis of decurling roll 130 which is significantly larger than the radius of the hard rollers 136. Thus, when the idler roll 132, which is of a uniform radius throughout its effective length, is disposed or urged against the decurling roll 130, the deformable rollers 134, which are relatively soft, are effectively indented when the idler roll 132 contacts the hard rollers 136. In addition, in an embodiment there may further be provided a spring force, indicated in FIG. 6 as 138 and typically provided by a coil spring (not shown), which urges the idler roll 132 against the decurling roll 130. In an embodiment, fuser roll 12 and the decurling roll 130 are driven by a common drive means, indicated in FIG. 6 schematically as 140, which would typically include an arrangement of gears, pulleys, etc., which in turn would connect to a drive system external to the module 10, such as within a copier or printer.

Figure 7:
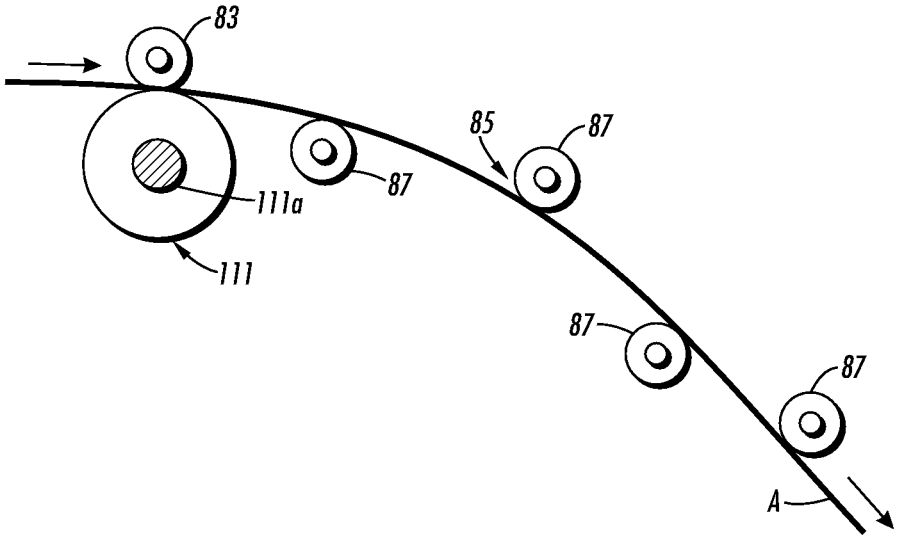
FIG. 7 is a schematic diagram of a decurler according to embodiments herein.

In an alternative embodiment shown in FIG. 7, the decurling mechanism uses standard transport rollers are used as the decurling mechanism instead of a separate decurl unit. Such a structure is described, for example, in U.S. Patent Publication 2005/0068410, which is incorporated herein by reference. In such a decurling mechanism, standard transport rollers can be used as the decurling mechanism instead of a separate decurl unit. The press roller 83, and the correcting and cooling rollers 87 are used to decurl the sheet. In FIG. 7, a heat roller 111 is in contact with the rear face of the film A, and the press roller 83 cooperates with the heat roller 111 to transport the thermal film A while clamping the film. The heat roller 111 incorporates a heating source such as a halogen heater 111*a*. When the heat roller 111 and the press roller 83 are rotated in synchronization with transportation of the thermal film A, a relative rubbing movement between the thermal film A and the heating unit can be eliminated, and hence the thermal recording layer of the thermal film A is not damaged.

While two types of decurler are described above, the embodiments here are not limited to such a decurler. Instead, any type of decurler, whether now known or developed in the future can be used with the interposer embodiments herein. Some examples of decurlers that are useful with the present embodiments follow. In U.S. Pat. No. 4,326,915 (the complete disclosure of which is incorporated herein by reference) a sheet decurler presses a sheet into contact with a substantially rigid arcuate member in at least two regions. U.S. Pat. No. 4,627,718 (the complete disclosure of which is incorporated herein by reference) discloses a decurler that includes a pair of co-acting rolls and a baffle extending across the path of a sheet exiting the nip between the rolls so as to deflect it about one of the rolls. U.S. Pat. No. 5,084,731 (the complete disclosure of which is incorporated herein by reference) discloses a fuser having a decurling mechanism associated therewith. A curl indicating device predicts the degree of inherent curl of a sheet, based on the amount of toner that had been placed on the sheet. A copy sheet having toned images having a charge value higher than a predetermined level is selectively deflected through a decurling nip. U.S. Pat. No. 5,202,737 (the complete disclosure of which is incorporated herein by reference) discloses a decurler including a rod deflecting a belt to define a nip therebetween. The belt is entrained about a pair of spaced rollers. The rod is adapted to translate in a vertical direction, and as the rod translates, the degree of deflection is varied and the bend of a sheet passing through the nip can be adjusted. Thus, the decurler 106 shown in FIG. 1 can comprise any of these types of decurlers.

Similarly, U.S. Pat. No. 5,221,950 (the complete disclosure of which is incorporated herein by reference) discloses an idler roller assembly that prevents jams and image deletion in copier/printers by removing a corrugation in sheets before they reach sharp turns. The assembly includes a shaft into which idler rollers are mounted with the shaft having a bend in the middle in order to provide a condition to steer out any existing sheet corrugation. Also, U.S. Pat. No. 5,398,107 (the complete disclosure of which is incorporated herein by reference) discloses an electrophotographic print engine in which the photoconductor drum interfaces with a transfer drum to form a transfer nip therebetween. Paper approaching the transfer nip is fed first between two precurl rollers. The durometers of the two precurl rollers are different, such that one roller will cause the other to compress. This causes the paper to have a curvature bias in the direction of the curvature of the photoconductor drum. Downstream of the photoconductor drum, the fuser mechanism has associated therewith two rollers which apply a curvature bias in the opposite direction to that provided by the precurl rollers, to return the paper to a substantially planar conformation. Thus, the decurler 106 shown in FIG. 1 can also comprise any of these types of decurlers.

Further, U.S. Pat. No. 5,555,083 (the complete disclosure of which is incorporated herein by reference) discloses a decurler for reducing cross-curl in sheets. The decurler includes at least one grooved elastomer transport belt and ribbed pinch shaft. The ribs of the decurler shaft extend into the grooves in the belt to provide one-sided corrugations to a passing sheet and provide distributed localized bending of a copy sheet in the area of the belt grooves. Thus, the decurler 106 shown in FIG. 1 can also comprise any of these types of decurlers.

U.S. Patent Publication 2005/0286958 (the complete disclosure of which is incorporated herein by reference) describes a decurling roller that is provided between a thermal head and a transport roller, providing a decurling roller downstream from a thermal head, whereby warpage of the sheet caused by the heating can be corrected. U.S. Pat. No. 6,603,954 (the complete disclosure of which is incorporated herein by reference) describes an external, portable decurl module which sits in the printer's sheet output receiving tray. U.S. Pat. No. 6,094,560 (the complete disclosure of which is incorporated herein by reference) describes a moisturizing and decurling apparatus, mounted immediately downstream of a fusing apparatus in an electrostatographic reproduction machine, that removes curl from a copy sheet. Thus, the decurler 106 shown in FIG. 1 can also comprise any of these types of decurlers.

The word "printer" or "image output terminal" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

What is claimed is:

1. An apparatus comprising:

a printing engine; and an interposer module including feed rollers, a diverter, and a paper path beginning with an entrance and terminating in an exit, said interposer module receiving printed sheets from said printing engine at said entrance, wherein said feed rollers and said diverter add insert sheets between said printed sheets, and wherein said interposer module comprises a decurler positioned within said interposer module as distant from said printing engine as the confines of said interposer allow and immediately adjacent said exit of said interposer module so as to decurl said printed sheets after said feed rollers and said diverter add said insert sheets, wherein said decurler comprises one of a roller-based decurler, a heated decurler, a pressure based decurler, and a moisture-vacuum based decurler.

2. The apparatus according to claim 1, wherein said printing engine adds a curl to said printed sheets and wherein said decurler is adapted to remove said curl from said printed sheets.

3. The apparatus according to claim 1, further comprising one of static brushes and static baffles positioned between said decurler and said exit of said interposer.

4. An apparatus comprising:

a printing engine; and an interposer module including feed rollers, a diverter, and a paper path beginning with an entrance and terminating in an exit, said interposer module receiving printed sheets from said printing engine at said entrance, wherein said feed rollers and said diverter add insert sheets between said printed sheets, wherein said interposer module comprises a decurler positioned within said interposer module as distant from said printing engine as the confines of said interposer allow and immediately adjacent said exit of said interposer module so as to decurl said printed sheets after said feed rollers and said diverter add said insert sheets, and wherein said interposer module further comprises a single controller connected to said decurler and said interposer, wherein said single controller is adapted to simultaneously control operations of said interposer and said decurler.

5. The apparatus according to claim 4, wherein said printing engine adds a curl to said printed sheets and wherein said decurler is adapted to remove said curl from said printed sheets.

6. The apparatus according to claim 4, wherein said decurler comprises one of a roller-based decurler, a heated decurler, a pressure based decurler, and a moisture-vacuum based decurler.

7. The apparatus according to claim 4, further comprising one of static brushes and static baffles positioned between said decurler and said exit of said interposer.

8. An apparatus comprising:

an interposer module including feed rollers, a diverter, and a paper path beginning with an entrance and terminating in an exit, said interposer module receiving printed sheets from a printing engine at said entrance, wherein said feed rollers and said diverter add insert sheets between said printed sheets, wherein said interposer comprises a decurler positioned within said interposer module as distant from said printing engine as the confines of said interposer allow and immediately adjacent said exit of said interposer module so as to decurl said printed sheets after said feed rollers and said diverter add said insert sheets.

9. The apparatus according to claim 8, wherein said decurler is adapted to remove a curl from said printed sheets.

10. The apparatus according to claim 8, wherein said decurler comprises one of a roller-based decurler, a heated decurler, a pressure based decurler, and a moisture-vacuum based decurler.

11. An apparatus comprising:

an interposer module including feed rollers, a diverter, and a paper path beginning with and entrance and terminating in an exit, said interposer module receiving printed sheets from a printing engine at said entrance, wherein said feed rollers and said diverter add insert sheets between said printed sheets, wherein said interposer comprises a decurler positioned within said interposer module as distant from said printing engine as the confines of said interposer allow and immediately adjacent said exit of said interposer module so as to decurl said printed sheets after said feed rollers and said diverter add said insert sheets, and wherein said interposer module further comprises a single controller connected to said decurler and said interposer, wherein said single controller is adapted to simultaneously control operations of said interposer and said decurler.

12. The apparatus according to claim 11, wherein said decurler is adapted to remove a curl from said printed sheets.

13. The apparatus according to claim 11, wherein said decurler comprises one of a roller-based decurler, a heated decurler, a pressure based decurler, and a moisture-vacuum based decurler.

14. The apparatus according to claim 11, further comprising one of static brushes and static baffles positioned between said decurler and said exit of said interposer.

* * * * *